US009120540B1

(12) United States Patent
Foss et al.

(10) Patent No.: US 9,120,540 B1
(45) Date of Patent: Sep. 1, 2015

(54) MARINE VESSEL DIVE PATIO

(71) Applicants: Charles Dean Foss, New Smyrna Beach, FL (US); Paul Sherwood-Berndt, Titusville, FL (US)

(72) Inventors: Charles Dean Foss, New Smyrna Beach, FL (US); Paul Sherwood-Berndt, Titusville, FL (US)

(73) Assignee: Boston Whaler, Inc., Edgewater, FL (US)

( * ) Notice: Subject to any disclaimer, the term of this patent is extended or adjusted under 35 U.S.C. 154(b) by 0 days.

(21) Appl. No.: 14/177,788

(22) Filed: Feb. 11, 2014

(51) Int. Cl.
*B63B 19/00* (2006.01)
*E05C 9/06* (2006.01)
*B63B 27/00* (2006.01)

(52) U.S. Cl.
CPC ..... *B63B 27/00* (2013.01)

(58) Field of Classification Search
CPC ..... B63B 27/00; B63B 27/14; B63B 27/143; B63B 2027/00; B63B 2027/14; B63B 27/141
USPC ..... 114/117, 343, 362, 364
See application file for complete search history.

(56) References Cited

U.S. PATENT DOCUMENTS

| | | | | |
|---|---|---|---|---|
| 2,558,975 | A | 7/1951 | Moreno et al. | |
| 4,733,752 | A | 3/1988 | Sklar | |
| 4,907,673 | A | 3/1990 | Ginter et al. | |
| 5,537,949 | A | 7/1996 | Blevins et al. | |
| 5,915,328 | A | 6/1999 | Rowan | |
| 6,182,598 | B1 * | 2/2001 | Bozzo | 114/362 |
| 7,004,101 | B1 | 2/2006 | Mardikian | |
| 7,409,921 | B1 | 8/2008 | Jones | |
| 8,146,526 | B2 | 4/2012 | Gros | |
| 8,365,472 | B2 | 2/2013 | Grimaldi | |
| 8,800,470 | B1 * | 8/2014 | Cummings | 114/362 |

* cited by examiner

*Primary Examiner* — Daniel V Venne
(74) *Attorney, Agent, or Firm* — Malin Haley DiMaggio & Bowen, P.A.

(57) ABSTRACT

A dive door for a marine vessel comprising a planar body having an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached to the door and the boat such that the dive door is selectively operable between a deployed position and a closed position. When deployed, the interior surface of the dive door extends outwardly from the boat. In the closed position, the outer surface of the dive door is matches the profile of the gunwale, providing a sleek integrated look. A ladder may hinged to the dive door and is configured to extend downward into the water surface when the door is deployed.

4 Claims, 3 Drawing Sheets

MARINE VESSEL DIVE PATIO

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to marine vessels and components related thereto and more specifically to a dive patio for marine vessels.

2. Description of Related Art

Easy and safe access in and out of marine vessels has always been a significant obstacle. Generally, a boater has to climb over the gunwale (hull walls) of a vessel or otherwise obtain access from the bow or stern. Particularly where diving and swimming is concerned, it is conventional to simply provide a dive ladder hanging off the transom at the rear of the vessel because the gunwales are generally intact and don't provide easy access to the water. The problem with a transom ladder is the risk of injury or death from the boat coming near or in contact with the propeller or other moving parts at or under the rear of the vessel. Accordingly, there is a desire to provide easy access off the side of the vessel, away from the propeller, which is much safer. However, common solutions such as removable doors or gaps in the gunwale are generally unsightly and/or affect the seaworthiness of the vessel. Accordingly, there is a significant need in the art of marine vessels to provide for a better means of ingress and egress off the side of the vessel to which the present invention is direction. However, in view of the dive/boarding doors in existence at the time of the present invention, it was not obvious to those persons of ordinary skill in the pertinent art as to how the identified needs could be fulfilled in an advantageous manner.

SUMMARY OF THE INVENTION

The present invention provides a dive door for a marine vessel comprising a planar body having an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached at one end to the dive door and at another end to the gunwale; and, by way of the gas shocks, the dive door is selectively operable between a deployed position and a closed position, wherein in the deployed position, the interior surface of the dive door extends outwardly from the boat. In the closed position, the outer surface of the dive door is substantially coincident with said gunwale of the vessel, providing a sleek integrated look. A ladder may optionally be hingeably attached to the dive door and is configured to extend downward into the water surface when the door is deployed.

Accordingly, it is an object of the present invention to provide a dive/access door for an boat that, when deployed, provides a platform surface that extends outwardly from the boat in order to provide increased ingress and egress surface area.

It is another object of the present invention to provide a dive/access door for an boat that can be actuated by a user on the boat, without the need to manually remove, slide, or alter any of the structural components of the boat.

It is yet another object of the present invention to provide a dive/access door for an boat that appears integrated with the gunwale thereof when closed, but provides a large, stable, and sturdy surface when deployed.

In accordance with these and other objects which will become apparent hereinafter, the instant invention will now be described with particular reference to the accompanying drawings.

DETAILED DESCRIPTION

Figure 1:
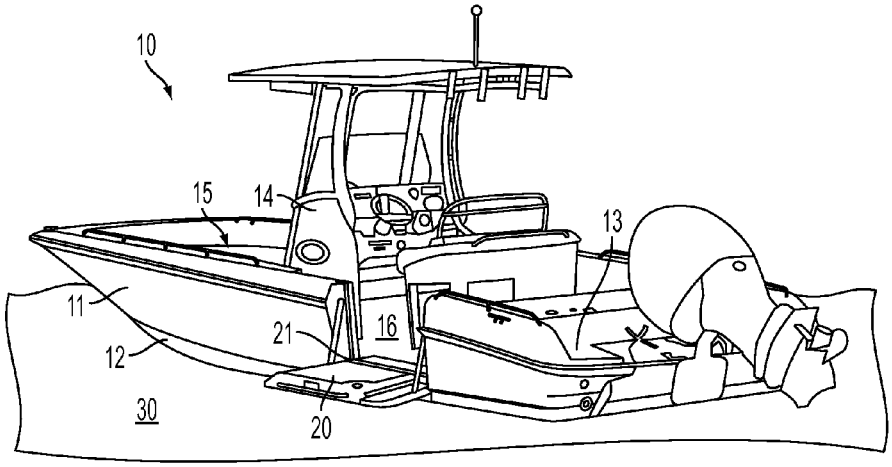
FIG. 1 is a perspective view of a vessel including one embodiment of the present invention.

With reference to FIG. 1, shown is a boat 10 configured generally as a conventional center-console style fiberglass hulled marine vessel. As shown, boat 10 includes gunwale 11 defining the walls of the vessel that are fixedly attached to a hull 12. In some embodiments, the gunwale 11 is provided around the perimeter of the hull 12 and terminates at or near the transom 13 at the stern of the vessel 10. In some embodiments, boat 10 also includes a center console 14, and a deck 15 but these features are not to be construed as limiting because other boat and vessel configurations may be equally suitable with regard to the dive door of the present invention.

Figure 2:
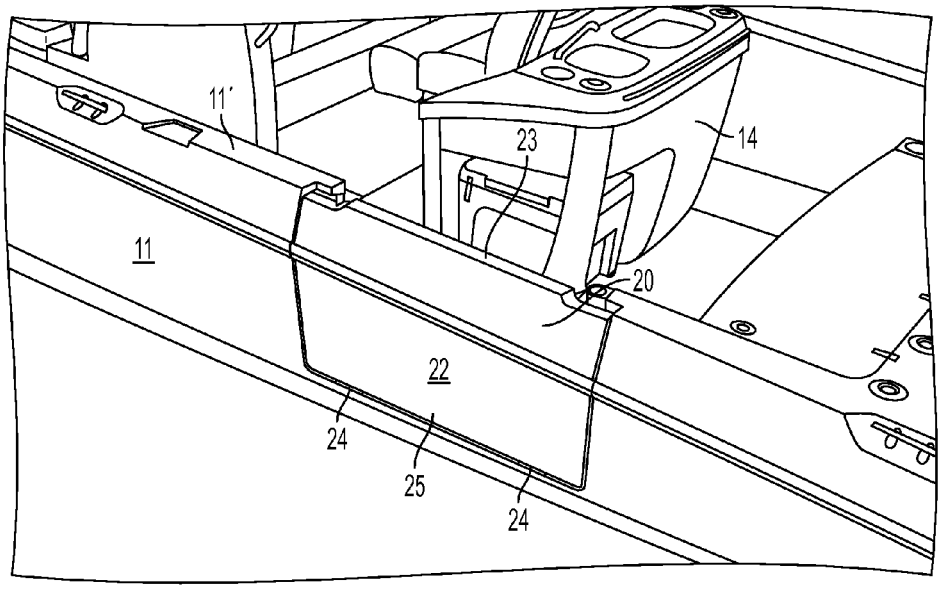
FIG. 2 is a perspective view of one embodiment of the present invention from the exterior of the vessel.
Figure 3:
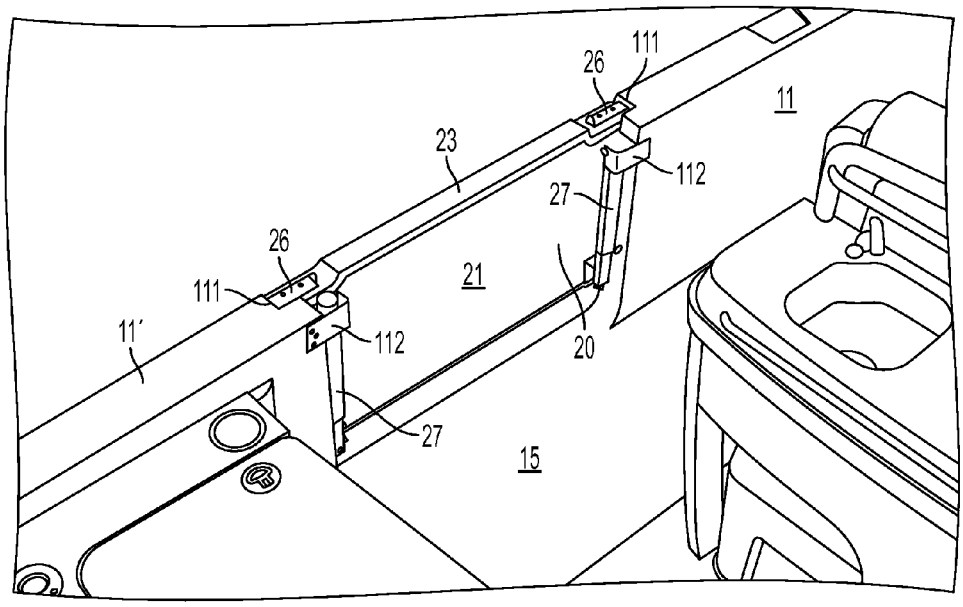
FIG. 3 is a perspective view of one embodiment of the present invention from the interior of the vessel.

Provided at a predetermined location along the gunwale 11 is an opening 16 to which the dive door 20 of the present invention is disposed. In FIG. 1, dive door 20 is shown in an open position proximal to the water surface 30. As shown in FIGS. 1 and 2, door 20 is generally configured as a planar body matching the dimensions of the gunwale 11 and having an interior surface 21 and an exterior surface 22. FIG. 2 also shows the dive door 20 having a top edge 23 matching the terminal edge 11' of the gunwale 11. Door 20 is hingeably attached to a portion of deck 15 by one or more hinges 24 which are attached along the length of the bottom edge 25 of the dive door 20. Hinges 24 provide a pivot point for door 20, such that door 20 can translate between at least two operative positions. FIG. 3 shows the present invention from an interior perspective of the boat 10. Shown is dive door 20 in a closed position with interior surface 21 facing to the inside of the boat 10. Also shown attached to top edge 23 of the dive door 20 are bi-lateral latches 26 that are configured to engage either side of the gunwale 11 for selective operation of the dive door 20. In some embodiments, latches 26 are slide-able latching members that engage notches 111 on the transom 11.

Figure 4:
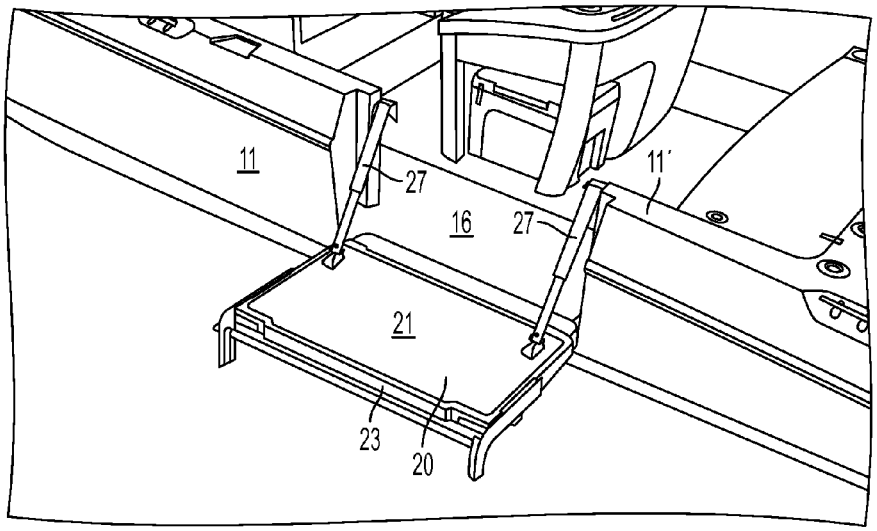
FIG. 4 is another perspective view of one embodiment of the present invention from the exterior of the vessel with the dive door in an open or deployed position.

Shown in FIGS. 3 and 4, the operable action of door 20 is controlled and assisted by one or more gas shocks 27 attached on one end to the dive door 20 and on the other end to the boat 10. As shown more clearly in FIG. 4, in some embodiments the shocks 27 are attached at one end on the interior surface 21 of the dive door 20 toward the bottom thereof and on the other end on the gunwale 11 at or toward the top edge 11'. In this configuration, two shocks 27 are provided in bi-lateral fashion. Shown in FIG. 3, in some embodiments, each of the shocks 27 are attached to the gunwale 11 by brackets 112 which also conceal and protect the shocks 27 from the interior of the boat 10.

Accordingly, when the dive door 20 is unlatched and deployed, shocks 27 exert an assisting force against interior surface 21, which when causes door 20 to rotate downward about hinges 24 to allow door 20 to be deployed in an "open" position, as shown in FIGS. 1 & 4. In the open position, interior surface 21 extends outwardly from the boat, providing an extended and stable surface to ingress and egress. In some embodiments, the interior surface 21 is substantially horizontal and parallel to the deck 16 of boat 10. Shocks 27 can also be assist in retracting door 20, pulling against surface 21 causing door 20 to rotate upward about hinges 24. This allows door 20 to move to a "closed" position, shown in FIGS. 2 & 3, wherein the interior surface 21 faces the inside of the boat 20, and the outer surface 22 is coincident with the gunwale 11. Shocks 27 are also useful for limiting the range of motion of door 20, while also being capable of locking door 20 in place, which is particularly helpful when door 20 is in its fully "open" position. Accordingly, shocks 27 can be used to resist downward movement or displacement of door 20 when forces are applied to surface 21 during use thereof.

Figure 5:
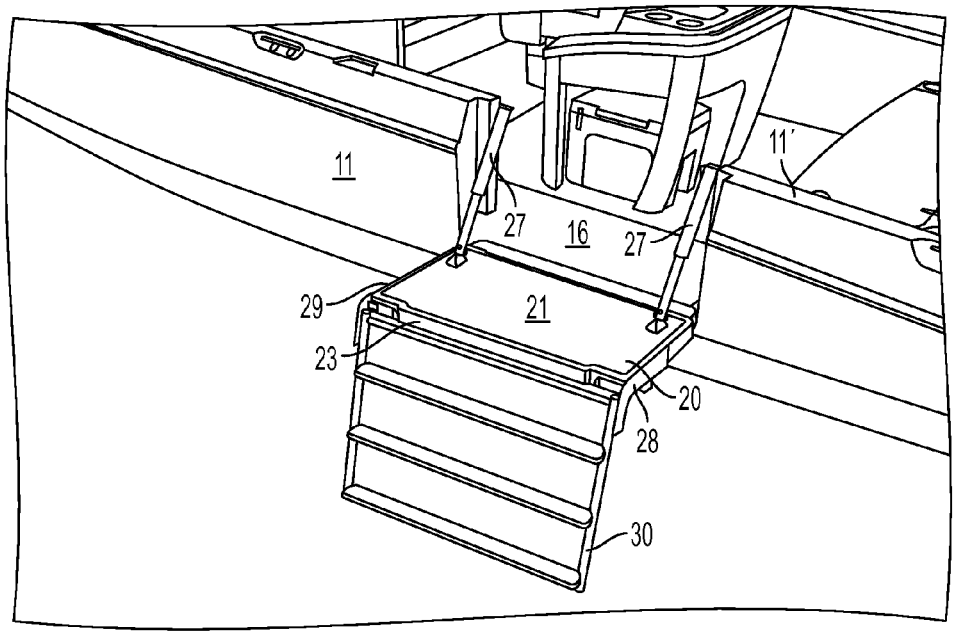
FIG. 5 is another perspective view of one embodiment of the present invention from the exterior of the vessel with the dive door and dive ladder in an open or deployed position.

An additional feature of the dive door 20 of the present invention is shown in FIG. 5. Attached to dive door 20 and hanging downward therefrom with then door 20 is in the open position is a dive ladder 30. Dive ladder 30 is configured to extend down into the water when the dive door 20 is in the deployed position. In some embodiments, dive ladder 30 is pivotably mounted to the side edge 28 and 29 of dive door 20 by way of a bracket or similar hardware. The ladder 30 has a plurality of horizontally disposed rungs 31 useful for the ingress and egress of a boater when the door 20 is deployed. The combination of the outwardly extending door 20, interior surface 21 functioning as a stable platform, and the ladder 30, the present invention provides a much improved means of entering and exiting boat 20 from the sides thereof.

It is appreciated that dive door 20 is comprised of a relatively buoyant material similar to the material used for the gunwale 11 of the boat 10 although it may be desirous to refinforce the dive door 20 so that it can better accept loads from individuals utilizing the door. In the open position, at least a portion of exterior surface 21 is in contact with the water, and the relatively buoyant door 20 will float thereon.

Further, as shown in the exemplary figures, in some embodiments, the outer surface 22 of the dive door 20 is configured to have substantially the same dimensions and profile of the gunwale 11. Accordingly, in the closed position, the outer surface 22 of door 20 will be substantially coincident with the gunwale 11. This configuration makes it appear as though door 20 is integrated with gunwale 11 such that the boat 10 has unified gunwale 11 around the entire perimeter of the vessel.

The present invention provides a substantial improvement of existing dive/access doors for marine vessels. Notably, the present invention provides a deployable dive door that provides a wide, flat, and horizontal platform surface when in use. The extended working platform surface or interior surface 21 is desirable because it provides ample space for transferring equipment and individuals. Furthermore, the overall design of the present invention is such that the door 20 appears integrated and contiguous with the gunwale 11 of the boat 10 by way of the curved surface 22 which is preferably dimensioned to match the size, shape, and configuration of the gunwale tubing sections. This configuration also enhances the seaworthiness of boat 10 as compared to door designs which merely provide a removable section or a gap in the gunwale tubing. Finally, the use of the gas shocks 27 provide for easier deployment and retraction of door 20, which is a substantial improvement over the existing removable or slideable dive door designs, which require a user to manually move and manipulate the door.

It is appreciated that the length, dimensions, and overall size of the dive door and its components can be changed as desired, depending on the specific application. Furthermore, while the foregoing makes reference to the term "dive door," the specific functionality and/or intended use of present invention is not limited to "diving" application. Rather, the term dive door is to be construed generally as a door providing access to the water from the boat 10 whether for recreational, commercial, or rescue use. Accordingly, the instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dive door for marine vessel, comprising:

a planar body having an interior surface and an exterior surface;

said door hingeably attached to a deck portion of said marine vessel;

said door disposed between a gunwale of said marine vessel;

said door releasably retained to said gunwale by one or more latches disposed at a top edge of said dive door;

one or more gas shocks attached at one end to said dive door and at another end to said gunwale; and wherein, by way of said gas shocks, said dive door is selectively operable between a deployed position and a closed position, wherein in said deployed position, said interior surface extends outwardly from said marine vessel.

2. The dive door of claim 1, wherein in said closed position, said outer surface is substantially coincident with said gunwale of said vessel.

3. The dive door of claim 1, wherein said door is hingeably attached to said deck portion of said boat by one or more hinges attached along a bottom edge of said dive door.

4. The dive door of claim 1, wherein a ladder is hingeably attached to said dive door and is configured to extend downward from said deck when said dive door is in said deployed position.

* * * * *